US010731574B2

(12) United States Patent
Evaldsson et al.

(10) Patent No.: US 10,731,574 B2
(45) Date of Patent: Aug. 4, 2020

(54) METHOD AND DEVICE FOR LIMITING THE TORQUE BUILD-UP OF AN ENGINE

(71) Applicant: SCANIA CV AB, Södertälje (SE)

(72) Inventors: Martin Evaldsson, Nacka (SE); Elvedin Ramic, Åkers Styckebruk (SE); Robin Rockström, Farsta (SE)

(73) Assignee: SCANIA CV AB (SE)

( * ) Notice: Subject to any disclaimer, the term of this patent is extended or adjusted under 35 U.S.C. 154(b) by 467 days.

(21) Appl. No.: 14/383,798

(22) PCT Filed: Feb. 26, 2013

(86) PCT No.: PCT/SE2013/050168
§ 371 (c)(1),
(2) Date: Sep. 8, 2014

(87) PCT Pub. No.: WO2013/147674
PCT Pub. Date: Oct. 3, 2013

(65) Prior Publication Data

US 2015/0134228 A1 May 14, 2015

(30) Foreign Application Priority Data

Mar. 27, 2012 (SE) ..... 1250294

(51) Int. Cl.
*F02D 29/02* (2006.01)
*F02D 41/10* (2006.01)
*F02D 28/00* (2006.01)

(52) U.S. Cl.
CPC ..... *F02D 29/02* (2013.01); *F02D 28/00* (2013.01); *F02D 41/10* (2013.01);
(Continued)

(58) Field of Classification Search
CPC ..... F02D 29/02; F02D 28/00; F02D 41/10; F02D 2250/21; F02D 2250/26;
(Continued)

(56) References Cited

U.S. PATENT DOCUMENTS 4,185,460 A * 1/1980 Moore ..... F02C 9/42 60/224
4,281,567 A * 8/1981 Maurer ..... B60W 10/06 477/110

(Continued)

FOREIGN PATENT DOCUMENTS

DE 10 2011 082 643 A1 3/2013
EP 1 281 853 B1 5/2010

(Continued)

OTHER PUBLICATIONS

"NPL_What the heck is torque steer_ (ABCs of Car Tech)—Roadshow"; published Jun. 28, 2012; retreived from the internet Jun. 13, 2018; https://www.cnet.com/roadshow/news/what-the-heck-is-torque-steer-abcs-of-car-tech/.*

(Continued)

*Primary Examiner* — Sizo B Vilakazi
*Assistant Examiner* — Brian R Kirby
(74) *Attorney, Agent, or Firm* — Ostrolenk Faber LLP

(57) ABSTRACT

A method for limitation of torque build-up of an engine (230) in a motor vehicle (100, 110), including the steps of continuously identifying (s410) a pattern pertaining to a maximum permissible torque (Tqmax); responding to torque demand (s420) by guiding torque build-up towards desired torque (Tqreq); responding to torque demand by continuously determining (s440) a difference (Tqdiff; Tqdiffnorm) between maximum permissible torque (Tqmax) and a prevailing torque (Tq); and controlling the torque build-up (s460) so that the resulting torque (Tq) is a function of the (Continued)

continuously determined difference (Tqdiff; Tqdiffnorm). Also a computer program product containing program code (P) for a computer (200; 210; 500) for implementing a method according to the invention. Also a device that performs the method and a motor vehicle (100; 110) equipped with the device are disclosed.

19 Claims, 4 Drawing Sheets

(52) U.S. Cl.
CPC .. *F02D 2200/604* (2013.01); *F02D 2200/606* (2013.01); *F02D 2250/21* (2013.01); *F02D 2250/26* (2013.01)

(58) Field of Classification Search
CPC ..... F02D 2200/606; F02D 2200/604; B60W 10/06; B60W 2710/0666; B60W 2540/10; B60W 2710/0644; B60W 2710/083; B60W 2710/105; B60W 2510/0657; B60W 30/18027; B60W 20/15; B60W 2710/0661; B60W 2510/0652; B60W 2540/106; B60W 2710/0672
USPC ..... 701/102, 103, 54, 84; 123/406.23
See application file for complete search history.

(56) References Cited

U.S. PATENT DOCUMENTS 4,355,550 A * 10/1982 Will ..... F02D 41/023 477/102
4,576,063 A * 3/1986 Akashi ..... F16H 3/006 74/331
4,732,125 A * 3/1988 Takizawa ..... F02D 41/0002 123/339.11
4,914,370 A * 4/1990 Sakamoto ..... G05B 19/19 318/561
4,915,076 A * 4/1990 Takizawa ..... F02D 41/0002 123/406.19
5,018,595 A * 5/1991 Hara ..... B60K 28/16 123/332
5,305,662 A * 4/1994 Togai ..... B60W 10/06 477/43
5,365,903 A * 11/1994 Watanabe ..... F02D 31/005 123/339.22
5,479,898 A * 1/1996 Cullen ..... F02D 41/0087 123/350
5,529,548 A * 6/1996 MacK ..... B60W 10/02 477/84
5,703,410 A * 12/1997 Maekawa ..... H02P 9/04 123/339.16
6,098,592 A * 8/2000 Hess ..... F02D 11/105 123/198 F
6,398,692 B1 * 6/2002 Isaac ..... B60K 28/16 123/486
6,440,041 B1 * 8/2002 Riedle ..... B60W 10/06 477/107
6,807,939 B1 * 10/2004 Doelker ..... F02D 31/009 123/350
7,027,908 B2 * 4/2006 Esteghlal ..... F02D 31/006 123/406.46
7,089,104 B2 * 8/2006 Post, II ..... F02D 41/021 180/197
7,171,299 B1 * 1/2007 Stroh ..... F02D 41/0225 701/110
7,596,446 B1 * 9/2009 Sakayanagi ..... F02D 11/105 123/434
7,869,931 B2 * 1/2011 Satou ..... F02D 41/123 701/101
8,550,054 B2 * 10/2013 Kociba ..... F02D 41/021 123/406.23
8,560,144 B2 * 10/2013 McGrogan ..... B60K 6/365 701/1
2002/0065596 A1 * 5/2002 Katakura ..... B60W 10/06 701/54
2002/0082760 A1 * 6/2002 Katakura ..... B60W 10/06 701/54
2004/0007205 A1 * 1/2004 Hartmann ..... F02D 41/0205 123/319
2004/0152562 A1 * 8/2004 Cullen ..... F16H 61/14 477/107
2004/0230362 A1 * 11/2004 Post, II ..... F02D 41/021 701/84
2005/0054482 A1 * 3/2005 Doering ..... F02D 41/0215 477/107
2005/0065691 A1 * 3/2005 Cho ..... F02D 11/105 701/54
2005/0187068 A1 * 8/2005 Kim ..... F16D 48/064 477/70
2005/0187696 A1 * 8/2005 Stroh ..... B60W 10/06 701/84
2006/0234830 A1 * 10/2006 Iriyama ..... B60W 10/06 477/109
2007/0043496 A1 * 2/2007 Ogawa ..... B60W 10/06 701/53
2007/0083316 A1 * 4/2007 Kurz ..... F02D 41/10 701/93
2007/0106451 A1 * 5/2007 Kuroda ..... F02P 5/103 701/103
2007/0161457 A1 * 7/2007 Geywitz ..... F02D 11/105 477/107
2007/0271026 A1 * 11/2007 Hijikata ..... F02D 11/105 701/103
2008/0058160 A1 * 3/2008 Kluemper ..... F16H 61/143 477/168
2008/0114521 A1 * 5/2008 Doering ..... B60W 30/16 701/96
2008/0254940 A1 * 10/2008 Stoffels ..... B60K 6/442 477/107
2008/0308066 A1 * 12/2008 Martin ..... B60K 6/445 123/403
2009/0037066 A1 * 2/2009 Kuwahara ..... F02D 41/1497 701/84
2009/0069971 A1 * 3/2009 Asahara ..... B60W 30/188 701/31.4
2009/0118922 A1 * 5/2009 Heap ..... B60W 10/105 701/54
2010/0057283 A1 * 3/2010 Worthing ..... F02D 41/1497 701/22
2010/0161188 A1 * 6/2010 Turski ..... B60T 8/175 701/67
2010/0161194 A1 * 6/2010 Turski ..... B60T 8/175 701/87
2010/0186522 A1 * 7/2010 Niemann ..... B60W 10/06 73/862.193
2010/0256894 A1 * 10/2010 Yasui ..... F02D 41/0235 701/108
2010/0280738 A1 * 11/2010 Whitney ..... F02D 11/105 701/102
2011/0082629 A1 * 4/2011 Soejima ..... F02P 5/14 701/54
2011/0087421 A1 * 4/2011 Soejima ..... F02D 41/0002 701/102
2011/0106388 A1 * 5/2011 Boeckenhoff ..... B60W 30/1882 701/70
2011/0132324 A1 * 6/2011 Kociba ..... F02D 41/021 123/406.23
2011/0178691 A1 * 7/2011 Wang ..... F02D 41/0002 701/102
2011/0191010 A1 * 8/2011 Russ ..... F02M 26/00 701/108
2011/0276239 A1 * 11/2011 Nagashima ..... F02D 37/02 701/54
2012/0138016 A1 * 6/2012 Martin ..... F02D 37/02 123/406.23
2012/0323401 A1 * 12/2012 McGrogan ..... B60K 6/365 701/1

(56) References Cited

U.S. PATENT DOCUMENTS

| | | | | |
|---|---|---|---|---|
| 2013/0325291 | A1* | 12/2013 | Kar | F02D 41/107 701/102 |
| 2014/0046572 | A1* | 2/2014 | Jang | F02D 45/00 701/102 |
| 2014/0052359 | A1* | 2/2014 | Zhang | F02D 25/00 701/99 |
| 2014/0277873 | A1* | 9/2014 | Hartl | B60W 10/06 701/22 |

FOREIGN PATENT DOCUMENTS

| | | | | |
|---|---|---|---|---|
| JP | 2007309449 | A | * | 11/2007 |
| JP | 2014009666 | A | * | 1/2014 |
| WO | WO 01/27453 | | | 4/2001 |
| WO | WO 2010/062246 | A1 | | 6/2010 |

OTHER PUBLICATIONS

"NPL_1998 MitsubishiEclipseNewCarTestDrive"; published Nov. 10, 1999; retreived from the internet Jun. 13, 2018; http://www.newcartestdrive.com/frame/?PartnerID=galves&ReviewID=3776.*

Supplementary European Search Report, dated Mar. 14, 2016 issued in corresponding European Patent Application No. EP 13 76 7631. Total 2 pages.

International Search Report dated Jun. 28 2013 issued in corresponding International patent application No. PCT/SE2013/050168.

International Preliminary Report on Patentability dated Jun. 12 2014 issued in corresponding International patent application No. PCT/SE2013/050168.

* cited by examiner

METHOD AND DEVICE FOR LIMITING THE TORQUE BUILD-UP OF AN ENGINE

CROSS-REFERENCE TO RELATED APPLICATIONS

The present application is a 35 U.S.C. §§ 371 National Phase conversion of PCT/SE2013/050168, filed Feb. 26, 2013, which claims priority of Swedish Patent Application No. 1250294-4, filed Mar. 27, 2012, the contents of which are incorporated by reference herein. The PCT International Application was published in the English language.

TECHNICAL FIELD

The present invention relates to a method for limitation of torque build-up in an engine of a motor vehicle. The invention relates also to a computer program product comprising program code for a computer for implementing a method according to the invention. The invention also relates also to a device for limitation of torque build-up in an engine of a motor vehicle and to a motor vehicle equipped with the device.

BACKGROUND

Today's vehicles are quite complex with regard to controlling their operation. Various operating routines are currently stored in control units of vehicles to improve performance and also provide comfort for a driver of the vehicle.

A complex element of today's vehicles is that they are provided with various engine torque limiters which, when applicable, influence the vehicle's operation so that a maximum available torque for given operating points of the vehicle is limited. An example of an engine torque limiter is a so-called smoke limiter.

With regard to methods for providing drivers with a smooth and comfortable sensation when there is demand for more acceleration, various filter functions are currently stored in control units to limit torque build-up when great acceleration is demanded by the driver or an electronic torque demander. Using said filter functions results in smooth behaviour of the vehicle.

A disadvantage of said filter functions is that they entail certain time delays which may give a driver the impression that the vehicle's engine does not respond in desirable ways to demands for more acceleration. He/she might find this annoying or irritating.

Moreover, jerking in a power train may occur when operating a vehicle with said filter functions, particularly when there is demand for powerful acceleration, as when setting the vehicle in motion from stationary. Such jerks in the power train may themselves cause annoyance to the driver. They may also cause the vehicle to sway or rock, potentially further increasing the annoyance to the driver.

WO 01/27453 describes a method for controlling torque changes in a diesel engine provided with a control unit which controls fuel injection to the engine's cylinders on the basis of signals which comprise accelerator pedal position and engine speed.

US 2010/0280738 describes a method for controlling an engine and a control module for controlling an engine.

SUMMARY OF THE INVENTION

One object of the present invention is to propose a novel and advantageous method for limitation of torque build-up in an engine of a motor vehicle.

Another object of the invention is to propose a novel and advantageous device and a novel and advantageous computer program for limitation of torque build-up in an engine of a motor vehicle.

A further object of the invention is to propose a method, a device and a computer program for improving the performance of a motor vehicle A further object of the invention is to propose an alternative method, an alternative device and an alternative computer program for effecting limitation of torque build-up in an engine of a motor vehicle.

These objects are achieved with a method disclosed herein for limitation of torque build-up in an engine of a motor vehicle.

A proposed method for limitation of torque build-up in an engine of a motor vehicle comprises the steps of

- continuously identifying a pattern pertaining to a maximum permissible torque, and
- responding to torque demand by guiding said torque build-up towards torque demanded,
- responding to torque demand by continuously determining a difference between said maximum permissible torque and a prevailing torque, and
- controlling the torque build-up so that the resulting torque is a function of said continuously determined difference.

The demand for torque may exceed said maximum permissible torque.

Limiting torque build-up as a function of the difference between a prevailing torque and a maximum permissible torque, which maximum is defined by a torque limiter, makes it possible to achieve an initial desirable response without unnecessary time delays. It also achieves with advantage a smooth torque build-up when a prevailing torque approaches the maximum permissible torque.

The torque build-up may pertain to setting the vehicle in motion from stationary. In that case, improved performance of the vehicle is achieved in that transients in its power train are with advantage reduced by the innovative method. Moving off from stationary often calls for torque which exceeds a maximum permissible torque. The invention achieves both an initial desirable torque build-up and a smooth behaviour when a prevailing torque approaches a maximum permissible torque.

It should be noted that the method according to the invention may also be applicable on a vehicle which is travelling at a certain speed.

Said function may present a curve which has a concave underside in a coordinate system for torque and time, resulting in a desirable functionality of the vehicle which causes less lurching of vehicles during operation. Said function may be a second-degree function.

The method may further comprise the step

- when said difference is zero, of activating control of torque according to a function which represents said maximum permissible torque.

An effective change may thus be made between operating routines according to the innovative method and other operating routines which may for example control torque build-up according to a function on the sole basis of maximum permissible torque. Swaying or rocking of the vehicle may thus be eliminated or reduced to a minimum.

The vehicle may further perform the step of

- continuously standardising said difference determined with a maximum permissible torque.

The innovative method may thus be adapted to each unique individual vehicle. Said standardisation will account for the engine performance of each individual vehicle. A model for maximum permissible torque at different speeds of the engine may be stored in a memory of a control unit on board the vehicle.

The method may further comprise the step of choosing the curve pattern of said function on the basis of desired characteristics of said torque build-up, enabling a driver to influence torque build-up by choosing an operating mode. Examples of operating modes may comprise environment mode, sport mode or normal mode. The result is a versatile and user-friendly method according to one aspect of the present invention.

The method may comprise the step of activating said control of the torque build-up in response to demand for a torque which exceeds said maximum permissible torque. In this case the innovative method is only activated when a rapid torque build-up is demanded by, for example, a driver or some other torque demander, e.g. a cruise control function stored in a control unit.

The method is easy to implement in existing motor vehicles. Software for limitation of torque build-up in an engine of a motor vehicle according to the invention may be installed in a control unit of the vehicle during the manufacture of the vehicle. A purchaser of the vehicle may thus have the possibility of selecting the function of the method as an option. Alternatively, software which comprises program code for conducting the innovative method for limitation of torque build-up in an engine of a motor vehicle may be installed in a control unit of the vehicle on the occasion of upgrading at a service station, in which case the software may be loaded into a memory in the control unit. Implementing the innovative method is therefore cost-effective, particularly since no further vehicle components need be installed in the vehicle. Relevant hardware is currently already provided in the vehicle. The invention therefore represents a cost-effective solution to the problems indicated above.

Software which comprises program code for limitation of torque build-up in an engine of a motor vehicle is easy to update or replace. Moreover, different parts of the software which comprises program code for limitation of torque build-up in an engine of a motor vehicle may be replaced independently of one another. This modular configuration is advantageous from a maintenance perspective.

One aspect of the present invention is a proposed device for limitation of torque build-up in an engine of a motor vehicle. The device comprises means for continuously identifying a pattern pertaining to a maximum permissible torque, and means for responding to torque demand by guiding said torque build-up towards torque demanded, means for responding to demand for torque by continuously determining a difference between said maximum permissible torque and a prevailing torque, and means for controlling the torque build-up so that the resulting torque is a function of said continuously determined difference.

In the case of the device, said torque build-up may pertain to setting the vehicle in motion from stationary. In the case of the device, said function may present a curve which has a concave underside in a coordinate system for torque and time. In the case of the device, said function may be a second-degree function.

The device may further comprise means, when said difference is zero, for activating control of torque according to a function which represents said maximum permissible torque.

The device may further comprise means for continuously standardising said difference determined with a maximum permissible torque.

The device may further comprise means for choosing the curve pattern of said function on the basis of desired characteristics of said torque build-up.

The above objects are also achieved with a motor vehicle provided with the device for limitation of torque build-up in an engine of a motor vehicle. The vehicle may be a truck, bus or car.

One aspect of the invention is a proposed computer program for limitation of torque build-up in an engine of a motor vehicle, which program comprises program code stored on a non-transitory computer-readable medium for causing an electronic control unit or another computer connected to the electronic control unit to perform steps according to the disclosure herein.

Another aspect of the invention is a proposed computer program for limitation of torque build-up in an engine of a motor vehicle, which program comprises program code for causing an electronic control unit or another computer connected to the electronic control unit to perform according to the disclosure herein.

Another aspect of the invention is a proposed computer program product comprising a program code stored on a non-transitory computer-readable medium for performing method steps when the computer program is run on an electronic control unit or another computer connected to the electronic control unit.

Further objects, advantages and novel features of the present invention will become apparent to one skilled in the art from the following details, and also by putting the invention into practice. Whereas the invention is described below, it should be noted that it is not confined to the specific details described. One skilled in the art having access to the teachings herein will recognise further applications, modifications and incorporations within other fields, which are within the scope of the invention.

BRIEF DESCRIPTION OF THE DRAWINGS

For fuller understanding of the present invention and its further objects and advantages, the detailed description set out below should be read in conjunction with the accompanying drawings, in which the same reference notations pertain to similar items in the various diagrams and FIG. 1 schematically illustrates a vehicle according to an embodiment of the invention, FIG. 2 schematically illustrates a subsystem for the vehicle depicted in FIG. 1, according to an embodiment of the invention.

DETAILED DESCRIPTION OF THE DRAWINGS

Figure 1:
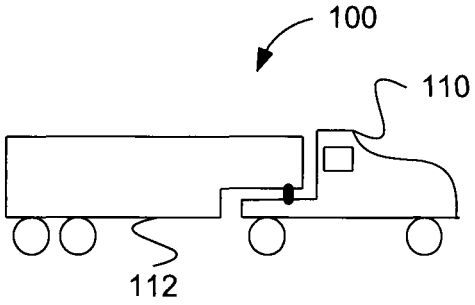

FIG. 1 depicts a side view of a vehicle 100. The vehicle here exemplified comprises a tractor unit 110 and a trailer 112. It may be a heavy vehicle, e.g. a truck or a bus. It may alternatively be a car.

The term "link" refers herein to a communication link which may be a physical connection such as an opto-electronic communication line, or a non-physical connection such as a wireless connection, e.g. a radio link or microwave link.

Figure 2:
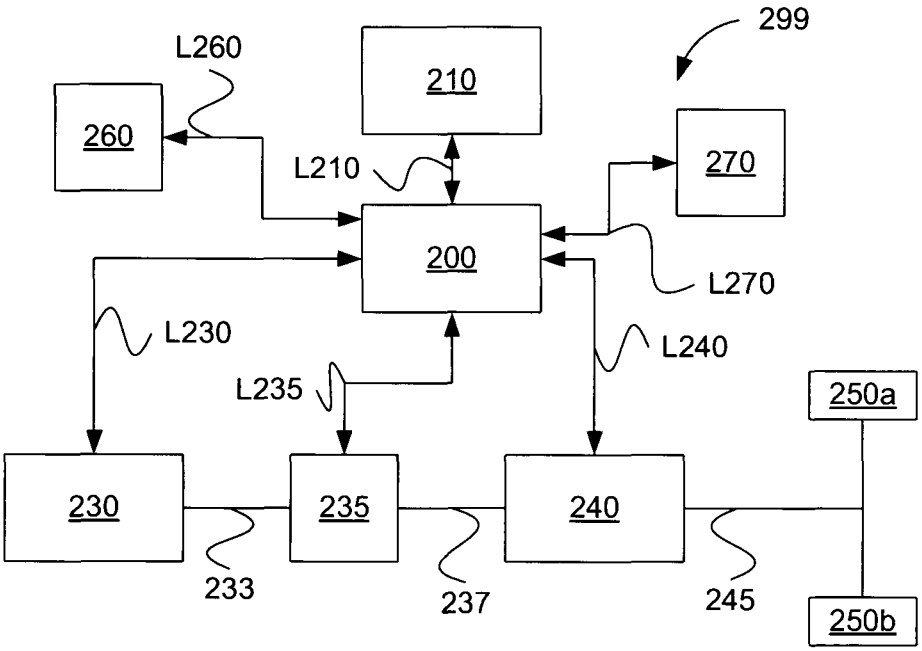

FIG. 2 depicts a subsystem 299 of the vehicle 100. The subsystem is situated in the tractor unit 110.

The subsystem 299 comprises a first control unit 200 which may comprise a device described in more detail with reference to FIG. 5.

The subsystem 299 comprises an engine 230 which may be a combustion engine. It may be a diesel engine with a suitable number of cylinders.

The engine 230 is adapted to conveying a torque generated to a clutch configuration 235 via a rotatably journalled shaft 233. The clutch configuration is adapted to transmitting torque in a controlled way to an automatically operated gearbox 240 via a rotatably journalled shaft 237. The clutch configuration may in one version be a disc clutch. The gearbox is adapted to transmitting a torque via an output shaft 245 to tractive wheels 250*a* and 250*b* of the vehicle.

The first control unit 200 is provided with communication with the engine 230 via a link L230 and is adapted to controlling the operation of the engine according to control routines stored in a memory of the control unit.

The first control unit 200 is provided with communication with the clutch configuration 235 via a link L235 and is adapted to controlling the operation of the clutch configuration according to control routines stored in a memory of the control unit.

The first control unit 200 is provided with communication with the gearbox 240 via a link L240 and is adapted to controlling the operation of the gearbox according to control routines stored in a memory of the control unit.

The subsystem 299 comprises a pedal system 260 which may be a two-pedal system comprising a braking means and an acceleration control. The pedal system is signal-connected to the first control unit 200 by means of a link L260. A driver may use the acceleration control to demand a desired torque from the engine 230.

Operating means 270 are provided for communication with the first control unit 200 via a link L270 and may comprise one or more push-buttons, a lever or a touchscreen. A driver may use said operating means to set a desired operating mode for the vehicle, e.g. an environment mode, sport mode or normal mode. A desired characteristic of a torque build-up according to the invention may thus be chosen by a driver.

The vehicle is provided with a number of engine torque limiters (not depicted). One example of an engine torque limiter may be a smoke limiter adapted to demanding limitation of a maximum permissible torque pertaining to vehicle operation in order thereby to reduce the amount of undesirable emissions from said engine 230.

Another example of a torque limiter may be a cruise control function adapted to demanding a torque from the engine 230 in order thereby to achieve desired operation of said engine.

Said torque limiter may be software in the form of operating routines for the first control unit 200.

The first control unit 200 is adapted to continuously identifying a pattern pertaining to a maximum permissible torque. It is adapted to responding to torque demand by guiding said torque build-up towards torque demanded. It is adapted to responding to demand for torque by continuously determining a difference between said maximum permissible torque and a prevailing torque. It is adapted to controlling the torque build-up so that the resulting torque is a function of said continuously determined difference. It is adapted, when said difference is zero, to activating control of torque according to a function which represents said maximum permissible torque. It is adapted to continuously standardising with a maximum permissible torque said difference determined. It is adapted to choosing the curve pattern of said function on the basis of desired characteristics of said torque build-up.

A second control unit 210 is provided with communication with the first control unit 200 via a link L210. The second control unit may be detachably connected to the first control unit. It may be situated externally to the vehicle 100. It may be adapted to performing the innovative method steps according to the invention. It may be used to crossload software to the first control unit, particularly software for conducting the innovative method. It may alternatively be provided with communication with the first control unit via an internal network of the vehicle. It may be adapted to performing substantially similar functions to the first control unit, e.g. using the signals received which contain a torque demanded by a driver as a basis for controlling torque build-up in accordance with the innovative method.

Figure 3:
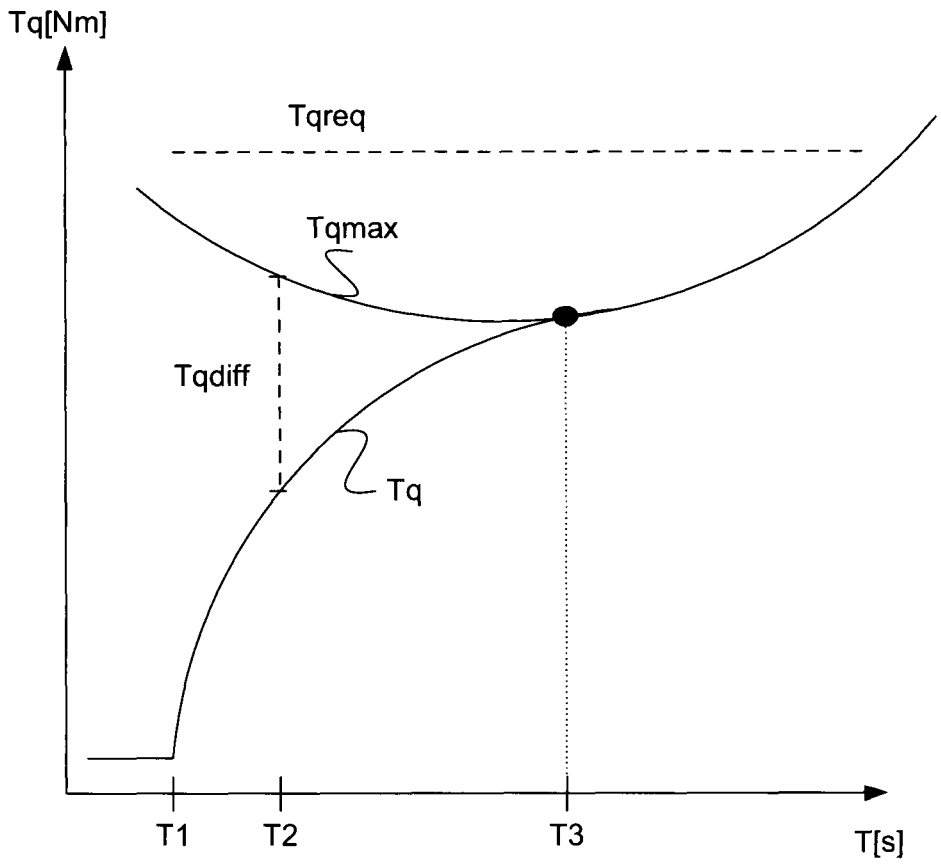
FIG. 3 is a diagram according to an aspect of the present invention.

FIG. 3 is a schematic diagram according to an aspect of the present invention.

It shows how a maximum permissible torque Tqmax depends on time T. Said maximum permissible torque Tqmax is determined continuously and is therefore defined by a dynamic pattern. It is determined continuously on the basis of data concerning a lowest permissible torque indicated by any of the vehicle's torque limiters. Among the vehicle's existing activated torque limiters, Tqmax is determined as being equal to the lowest permissible torque, chosen from among said activated torque limiters.

The diagram also describes a pattern for (limitation of) the engine's torque build-up. The build-up of a prevailing torque Tq of the engine 230 is plotted against time T.

At a first time T1 a torque Tqreq which at that time exceeds the maximum permissible torque Tqmax is demanded, e.g. by means of the pedal system 260.

According to the invention, a difference Tqdiff is continuously determined between said maximum permissible torque Tqmax and a prevailing torque Tq. The torque build-up is controlled so that the resulting torque is a function of said continuously determined difference Tqdiff. In one aspect of the invention, said difference Tqdiff is continuously standardised with a corresponding maximum permissible torque Tqmax.

An example of said difference Tqdiff is illustrated at time T2.

In one aspect of the invention the smaller said difference Tqdiff, the more slowly the prevailing torque Tq is allowed to increase, as schematically depicted in FIG. 3.

At time T3, the prevailing torque Tq will be substantially equal to the maximum permissible torque Tqmax and the control will thereupon switch to a different operating routine. In this example, control of torque is activated according to a function which represents said maximum permissible torque Tqmax.

Figure 4A:
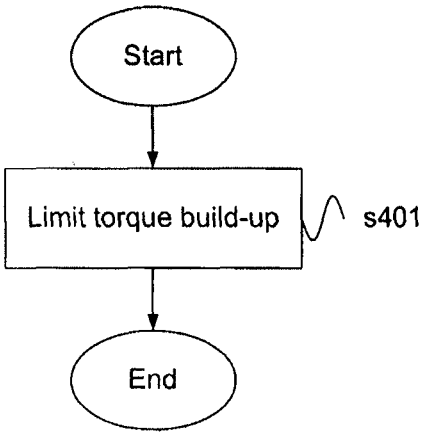
FIG. 4*a* is a schematic flowchart of a method according to an embodiment of the invention.

FIG. 4*a* is a schematic flowchart of a method for limitation of torque build-up in an engine of a motor vehicle according to an embodiment of the invention. The method comprises a first step s401 comprising the steps of

- continuously identifying a pattern pertaining to a maximum permissible torque, and
- responding to torque demand by guiding said torque build-up towards torque demanded, responding to torque demand by continuously determining a difference between said maximum permissible torque and a prevailing torque, and controlling the torque build-up so that the resulting torque is a function of said continuously determined difference. The method ends after step s401.

Figure 4B:
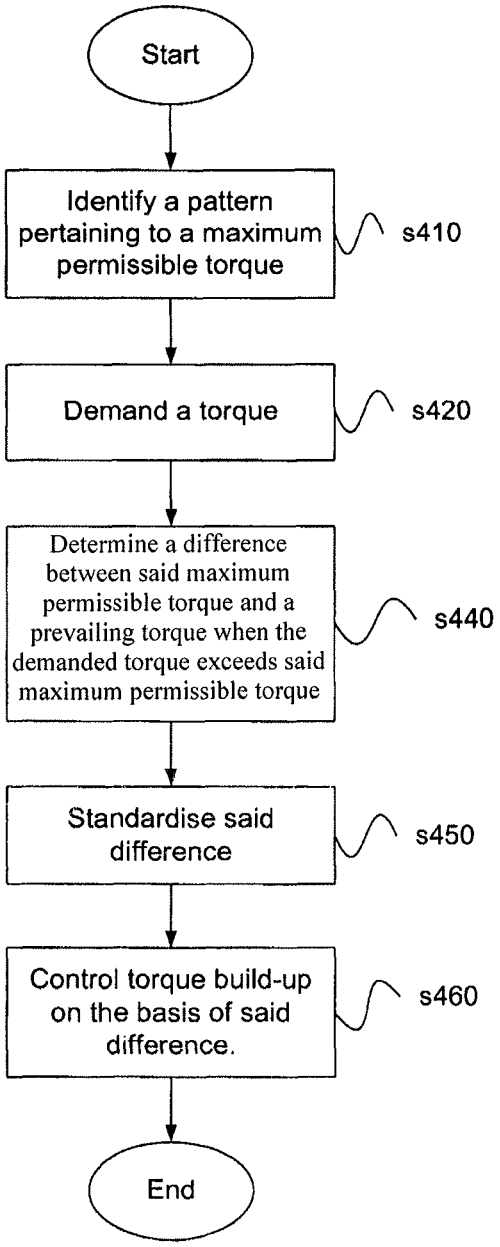
FIG. 4*b* is a more detailed schematic flowchart of a method according to an embodiment of the invention, and FIG. 5 schematically illustrates a computer according to an embodiment of the invention.

FIG. 4*b* is a schematic flowchart of a method for limitation of torque build-up in an engine of a motor vehicle according to an embodiment of the invention.

The method comprises a first step s410 of continuously identifying a pattern pertaining to a maximum permissible torque. This takes place continuously on the basis of the influence of various engine torque limiters of the vehicle 100. Step s410 is followed by a step s420.

Method step s420 comprises demanding a desired torque from the engine 230. This may be by a driver using the pedal system 260. Alternatively, some other torque demander may demand a torque. Step s420 is followed by a step s440.

Method step s440 comprises, when there is demand for torque which exceeds said maximum permissible torque, of continuously determining a difference Tqdiff between said maximum permissible torque Tqmax and a prevailing torque Tq. Step s440 is followed by a step s450.

Method step s450 comprises continuously standardising said difference determined Tqdiff with a maximum permissible torque. Information about said maximum permissible torque may be stored in a memory of a control unit of the vehicle 100. Said maximum permissible torque may be predetermined and be defined as a function of a prevailing engine speed. Step s450 is followed by a step s460.

Method step s460 comprises controlling the torque build-up so that the resulting torque is a function of said continuously determined difference Tqdiff. In one embodiment, method step s460 comprises controlling the torque build-up so that the resulting torque Tq is a function of said continuously determined standardised difference Tqdiffnorm. The method ends after step s460.

Figure 5:
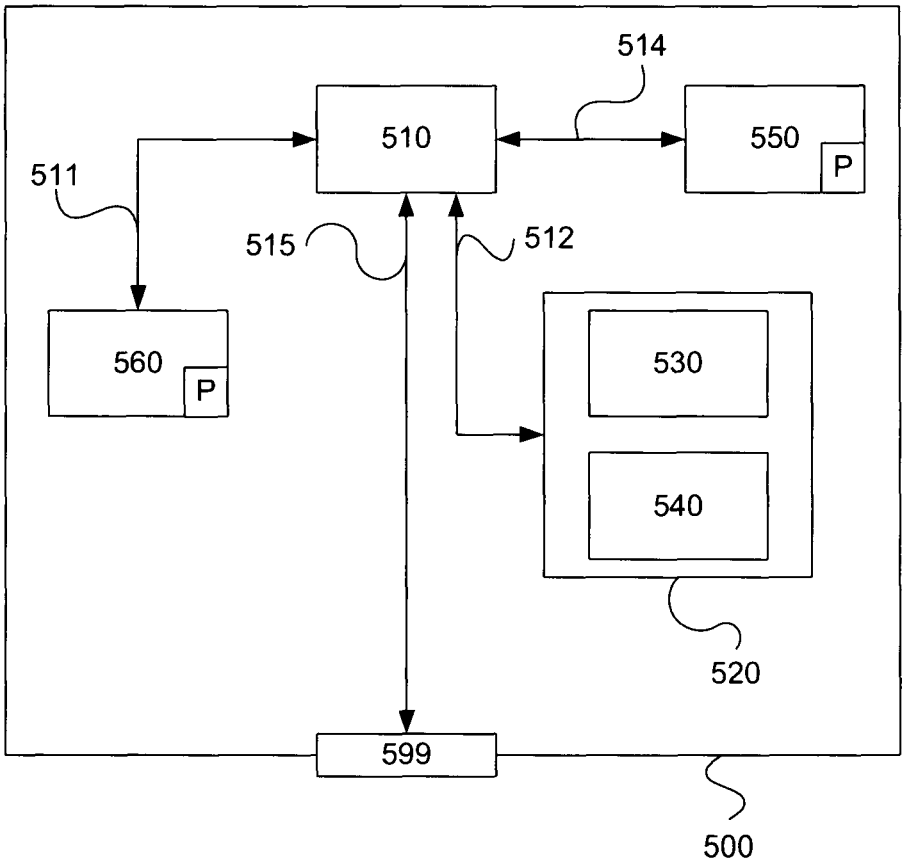

FIG. 5 is a diagram of a version of a device 500. The control units 200 and 210 described with reference to FIG. 2 may in one version comprise the device 500. The device 500 comprises a non-volatile memory 520, a data processing unit 510 and a read/write memory 550. The non-volatile memory 520 has a first memory element 530 in which a computer program, e.g. an operating system, is stored for controlling the function of the device 500. The device 500 further comprises a bus controller, a serial communication port, I/O means, an ND converter, a time and date input and transfer unit, an event counter and an interruption controller (not depicted). The non-volatile memory 520 has also a second memory element 540.

A proposed computer program P comprises routines for limitation of torque build-up in an engine of a motor vehicle, according to an aspect of the innovative method.

The program P comprises routines for continuously identifying a pattern pertaining to a maximum permissible torque. The program comprises routines for responding to torque demand by guiding said torque build-up towards torque demanded. It comprises routines whereby, when demand for torque exceeds said maximum permissible torque, a difference is continuously determined between said maximum permissible torque and a prevailing torque. It comprises routines for controlling the torque build-up so that the resulting torque is a function of said continuously determined difference. It comprises routines whereby, when said difference is zero, control of torque according to a function which represents said maximum permissible torque is activated. It comprises routines for continuously standardising with a maximum available torque said difference determined. It comprises routines for choosing the curve pattern of said function on the basis of desired characteristics of said torque build-up.

The program P may be stored in an executable form or in compressed form in a memory 560 and/or in a read/write memory 550.

Where the data processing unit 510 is described as performing a certain function, it means that the data processing unit 510 conducts a certain part of the program stored in the memory 560, or a certain part of the program stored in the read/write memory 550.

The data processing device 510 can communicate with a data port 599 via a data bus 515. The non-volatile memory 520 is intended for communication with the data processing unit 510 via a data bus 512. The separate memory 560 is intended to communicate with the data processing unit 510 via a data bus 511. The read/write memory 550 is adapted to communicating with the data processing unit 510 via a data bus 514. The data port 599 may for example have the links L210, L230, L235, L240 and L260 connected to it (see FIG. 2).

When data are received on the data port 599, they are stored temporarily in the second memory element 540. When input data received have been temporarily stored, the data processing unit 510 is prepared to conduct code execution as described above. In one version, signals received on the data port contain information about a torque demanded Tqreq. In one version, signals received on the data port contain information about a desired characteristic of a torque build-up. The signals received on the data port may be used by the device 500 to control torque limitation of the vehicle's engine according to an aspect of the innovative method.

Parts of the methods herein described may be conducted by the device 500 by means of the data processing unit 510 which runs the program stored in the memory 560 or the read/write memory 550. When the device 500 runs the program, methods herein described are executed.

The foregoing description of the preferred embodiments of the present invention is provided for illustrative and descriptive purposes. It is not intended to be exhaustive, nor to restrict the invention to the variants described. Many modifications and variations will obviously suggest themselves to one skilled in the art. The embodiments have been chosen and described in order best to explain the principles of the invention and their practical applications and thus make it possible for one skilled in the art to understand the invention for different embodiments and with the various modifications appropriate to the intended use.

The invention claimed is:

1. A method for limitation of torque build-up of an engine in a motor vehicle, comprising the steps of:

continuously determining a dynamic pattern pertaining to a maximum permissible torque that varies over time, said maximum permissible torque being continuously determined based on data concerning a lowest permissible torque indicated by any of at least one torque limiter of said motor vehicle;

responding to a demanded torque by guiding said torque build-up towards said demanded torque, said demanded torque being demanded by a user of said motor vehicle controlling acceleration and braking of said motor vehicle by at least one device;

and, while said demanded torque exceeds said maximum permissible torque, and while a prevailing torque is less than said maximum permissible torque and until said prevailing torque is equal to said maximum permissible torque, responding to said demanded torque by: (1) determining, a plurality of times, a difference between said maximum permissible torque and said prevailing torque; and setting said torque build-up towards said maximum permissible torque as a function of said determined difference each time a difference is determined between said maximum permissible torque and said prevailing torque, wherein said torque build-up is a rate of change of engine torque toward said maximum permissible torque.

2. The method according to claim 1, in which said torque build-up pertains to setting the vehicle in motion from stationary.

3. The method according to claim 1, wherein said function represents a curve with a concave underside in a coordinate system for torque and time.

4. The method according to claim 1, wherein said function is a second-degree function.

5. The method according to claim 1, further comprising the step, when said difference is zero, of activating control of torque according to a function which represents said maximum permissible torque.

6. The method according to claim 1, further comprising the step of continuously standardising said continuously determined difference with said maximum permissible torque.

7. The method according to claim 1, further comprising the step of choosing a curve pattern of said function on the basis of desired characteristics of said torque build-up.

8. A device for limitation of torque build-up of an engine in a motor vehicle, wherein the device is configured:

to continuously determine a dynamic pattern pertaining to a maximum permissible torque that varies over time, said maximum permissible torque being continuously determined based on data concerning a lowest permissible torque indicated by any of at least one torque limiter of said motor vehicle;

to respond to a demanded torque by guiding said torque build-up towards said demanded torque, said demanded torque being demanded by a user of said motor vehicle controlling acceleration and braking of said motor vehicle by at least one device; and while said demanded torque exceeds said maximum permissible torque, and while a prevailing torque is less than said maximum permissible torque and until said prevailing torque is equal to said maximum permissible torque, to respond to said demanded torque by: (1) determining, a plurality of times, a difference between said maximum permissible torque and said prevailing torque; and (2) setting said torque build-up towards said maximum permissible torque as a function of said determined difference each time a difference is determined between said maximum permissible torque and said prevailing torque, wherein said torque build-up is a rate of change of engine torque toward said maximum permissible torque.

9. The device according to claim 8, wherein said torque build-up pertains to setting the vehicle in motion from stationary.

10. The device according to claim 8, wherein said function represents a curve with a concave underside in a coordinate system for torque and time.

11. The device according to claim 8, wherein said function is a second-degree function.

12. The device according to claim 8, further configured to activate control of torque according to a function which represents said maximum permissible torque when said continuously determined difference is zero.

13. The device according to claim 8, further configured to continuously standardise said continuously determined difference with said maximum permissible torque.

14. The device according to claim 8, further configured to choose a curve pattern of said function on the basis of desired characteristics of said torque build-up.

15. A motor vehicle provided with the device according to claim 8.

16. A motor vehicle according to claim 15, which is any one from among a truck, a bus or a car.

17. An electronic control unit or another computer connected to the electronic control unit configured to execute program code stored on a non-volatile computer-readable medium, wherein the program code comprises the method steps according to claim 1.

18. The method according to claim 1, wherein said function of said continuously determined difference is such that the smaller said continuously determined difference is, the more slowly said prevailing torque is permitted to increase.

19. The device according to claim 8, wherein said function of said continuously determined difference is such that the smaller said continuously determined difference is, the more slowly said prevailing torque is permitted to increase.

* * * * *